US006193204B1

(12) United States Patent
Hsu

(10) Patent No.: US 6,193,204 B1
(45) Date of Patent: Feb. 27, 2001

(54) MUSIC STAND

(76) Inventor: Hsin-Hsuan Hsu, 11 Kung-5th Rd. Kung-2nd Industrial Zone, Lin-Kou Hsiang, Taipei (TW)

( * ) Notice: Subject to any disclaimer, the term of this patent is extended or adjusted under 35 U.S.C. 154(b) by 0 days.

(21) Appl. No.: 09/353,350

(22) Filed: Jul. 15, 1999

Related U.S. Application Data

(63) Continuation-in-part of application No. 09/038,140, filed on Mar. 11, 1998, now Pat. No. 5,979,856.

(51) Int. Cl.[7] ..... A47B 19/00
(52) U.S. Cl. ..... 248/441.1; 248/454; 248/460
(58) Field of Search ..... 248/441.1, 454, 248/460, 176.1, 178.1

(56) References Cited

U.S. PATENT DOCUMENTS

| | | | | |
|---|---|---|---|---|
| 513,195 | * | 1/1894 | McCann | 248/454 |
| 1,666,803 | * | 4/1928 | Walker | 248/454 |
| 3,408,032 | * | 10/1968 | Francis | 248/450 |
| 4,591,124 | * | 5/1986 | Hellenbrand et al. | 248/447.2 |
| 4,606,525 | * | 8/1986 | Lombardi | 248/460 |
| 5,692,719 | * | 12/1997 | Shepherd | 248/460 |
| 5,979,856 | * | 11/1999 | Hsu | 248/441.1 |
| 6,017,011 | * | 1/2000 | Lee | 248/441.1 |

* cited by examiner

*Primary Examiner*—Anita M. King
*Assistant Examiner*—N. Sanders
(74) *Attorney, Agent, or Firm*—Jacobson, Price, Holman & Stern, PLLC

(57) ABSTRACT

A music stand including a tripod, a telescopic rod installed on a tripod, a connector installed on the telescopic rod, a music rest installed on the connector, and a transverse tube installed on the connector. The music rest is formed by a plate frame formed by an L shape plate and a foldable plate pivotally installed on a transverse rod. The transverse rod of the music rest passes through the transverse tube on the connector. The transverse rod is movable within the transverse tube so that the foldable plate is turned downwards to be on the L shape plate. The music rest is pushed downwards in that the connector is pivotally installed on a top of the telescopic rod, two cambered plates are installed below the connector, and a cambered groove is formed on the cambered plate. A positioning stud passes through the cambered groove and is screwedly installed on the telescopic rod. By loosing or tightening the positioning stud the music rest on the connector can be easily turned.

1 Claim, 4 Drawing Sheets

MUSIC STAND

This application is a continuation-in-part of patent application Ser. No. 09/038,140, filed Mar. 11, 1998, U.S. Pat. No. 5,979,856.

BACKGROUND OF THE INVENTION

1. Field of the Invention

The present invention relates to a music stand, and especially to a music stand, the music rest of which is locked by a positioning stud, thus, the music rest can be tuned out for expansion or folded for storing.

2. Description of the Prior Art

The present invention is extended from patent application Ser. No. 09/038,140, filed Mar. 11, 1998, which is incorporated into the present invention as a reference. In the prior art patent, a music rest includes a tripod, a transverse rod, a music rest, and a connector, wherein the transverse tube is installed on the tripod, the music rest is connected to a transverse rod by a joint, characteristic in that a post is formed on the top of the transverse rod. Each side of the upper end of the transverse rod is installed with a long hole. The connector can be connected to the top of the transverse rod. Two sides of the connector are installed with long holes so that the connector can be pulled upwards and downwards so as to be inserted into the post on the top of the transverse tube. A stud serves to fix the connector, or the stud is released for pulling up the connector as to shift the connector. In the music rest, an upper plate and a lower plate are arranged on the connecting rod, where the upper plate is connected to the lower plate by a hinge. Thus the connecting rod transversally passes through the connector.

The upper plate of the music rest can be turned to resist against the lower plate, and the stud on the transverse tube is released. Then, the connecting rod is pulled up so that the connector is disengaged with the post of the transverse rod. Therefore, the music stand of the present invention has a reduced volume for storage. When expanding for use, the connector is turned upwards and shifted, so that the connector is connected to the post on the top of the transverse tube, then the stud is screwedly tightened so as to expand a music score.

However, if the music rest is desired to be folded for storing, the stud on the connector must be released, then the connector is pulled upwards so as to separate with the post on the top of the transverse tube, thus, the connector is shifted for folding the music rest. However, the action of disengaging the connector or pulling the post on the top of the transverse tube are inconvenient.

SUMMARY OF THE INVENTION

Accordingly, the object of the present invention is to provide a music stand comprising: a tripod, a telescopic rod installed on a tripod, a connector installed on the telescopic rod, a music rest installed on the connector, a transverse tube installed on the connector. The music rest is formed by a plate frame formed by an L shape plate and a foldable plate pivotally installed on a transverse rod. The transverse rod of the music rest passes through the transverse tube on the connector. The transverse rod is movable within the transverse tube so that the foldable plate is turned downwards to be on the L shape plate. Thus the music rest is pushed downwards and folded. The invention is characterized in that the connector is pivotally installed on a top of the telescopic rod, two cambered plates are installed below the connector and a cambered groove is formed on the cambered plate. A positioning stud passes through the cambered groove and screwedly installed on the telescopic rod. By loosing or tighten the positioning stud the connector on the music rest can be easily tuned.

The present invention will be better understood and its numerous objects and advantages will become apparent to those skilled in the art by referring to the following drawings in which:

DETAILED DESCRIPTION OF THE PREFERRED EMBODIMENT

Figure 1:
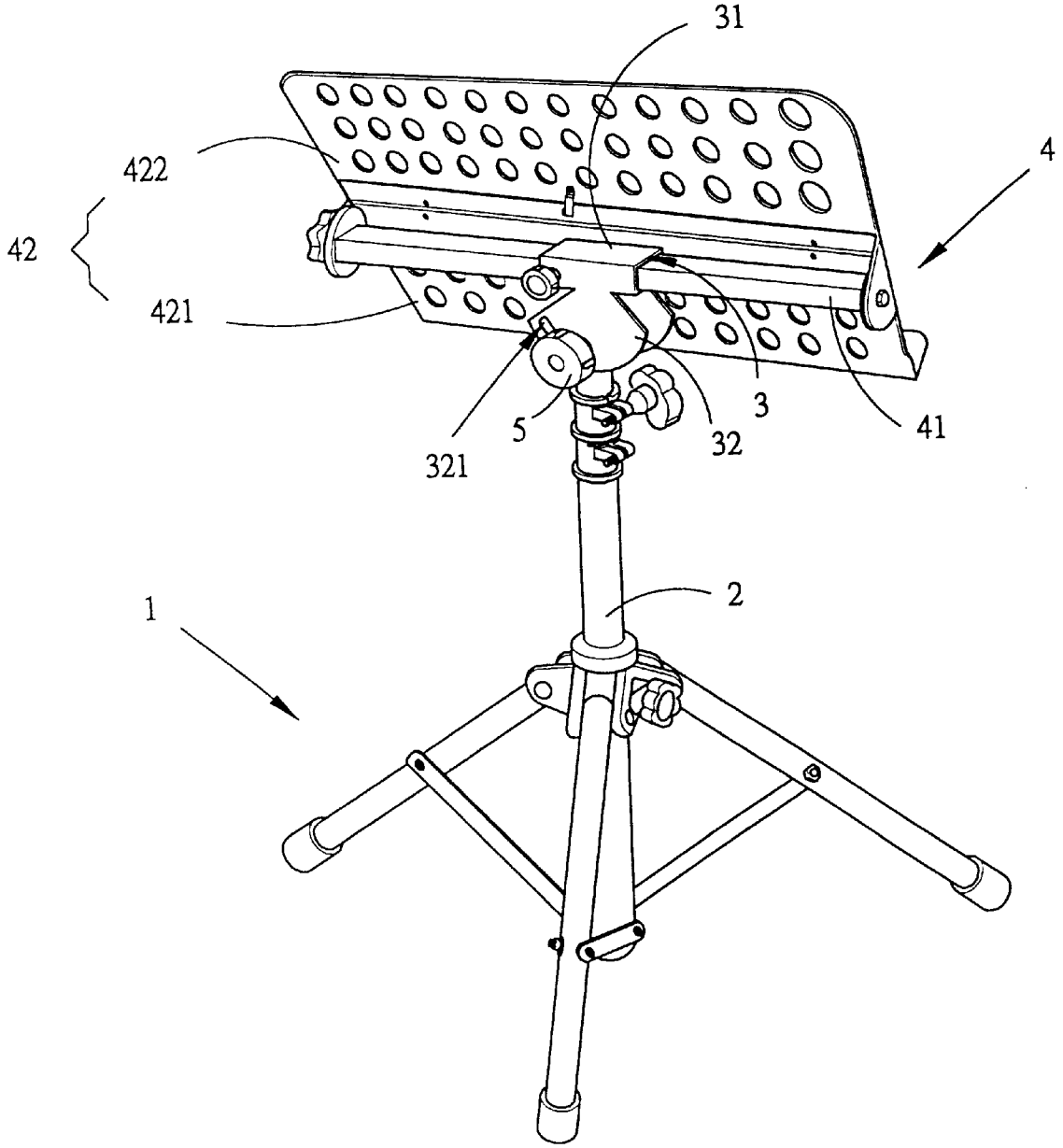
FIG. 1 is a perspective view of the present invention.
Figure 2:
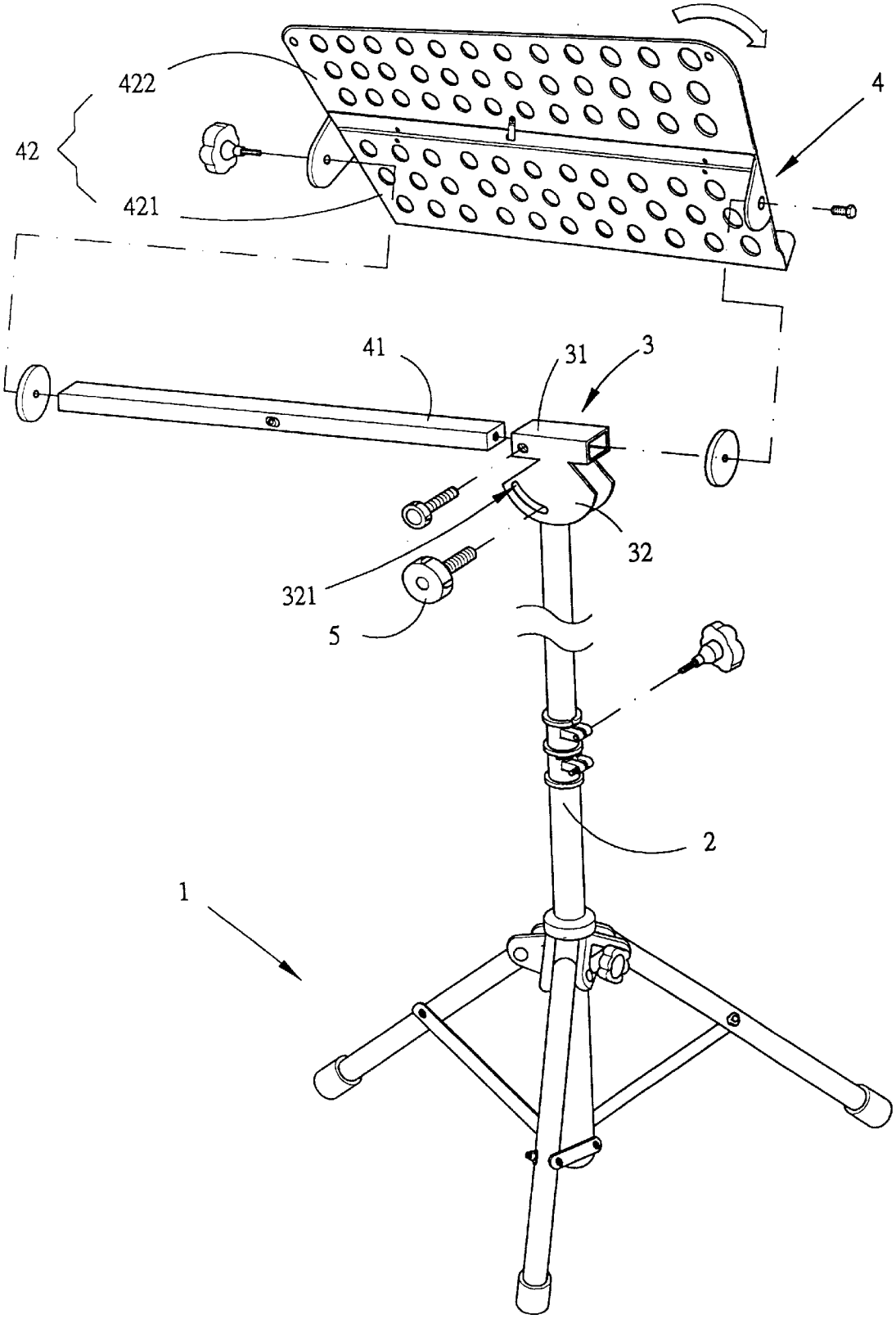
FIG. 2 is an exploded perspective view of the present invention.

At first, with reference to FIGS. 1 and 2, in the present invention, a telescopic rod 2 is installed on a tripod 1. A connector 3 is installed on the telescopic rod 2. The music rest 4 is installed on the connector 3. A transverse tube 31 is installed on the connector 3. A music rest 4 is formed by a plate frame 42 formed by an L shape plate 421 and a foldable plate 422 pivotally installed on a transverse rod 41. The transverse rod 41 of the music rest 4 passes through the transverse tube 31 on the connector 3. The transverse rod 41 is movable within the transverse tube 31 so that the foldable plate 422 will be turned downwards to be on the L shape plate 421, and thus the music rest 4 will be pushed downwards is folded.

The connector 3 is pivotally installed on the top of the telescopic rod 2. Two cambered plates 32 are installed below the connector 3 and a cambered groove 321 is formed on the cambered plate 32. A positioning stud 5 may pass through the cambered groove 321 and screwedly be installed on the telescopic rod 2. Thus, by loosing or tighten the positioning stud 5, the music rest 4 on the connector 3 can be easily tuned.

Figure 3:
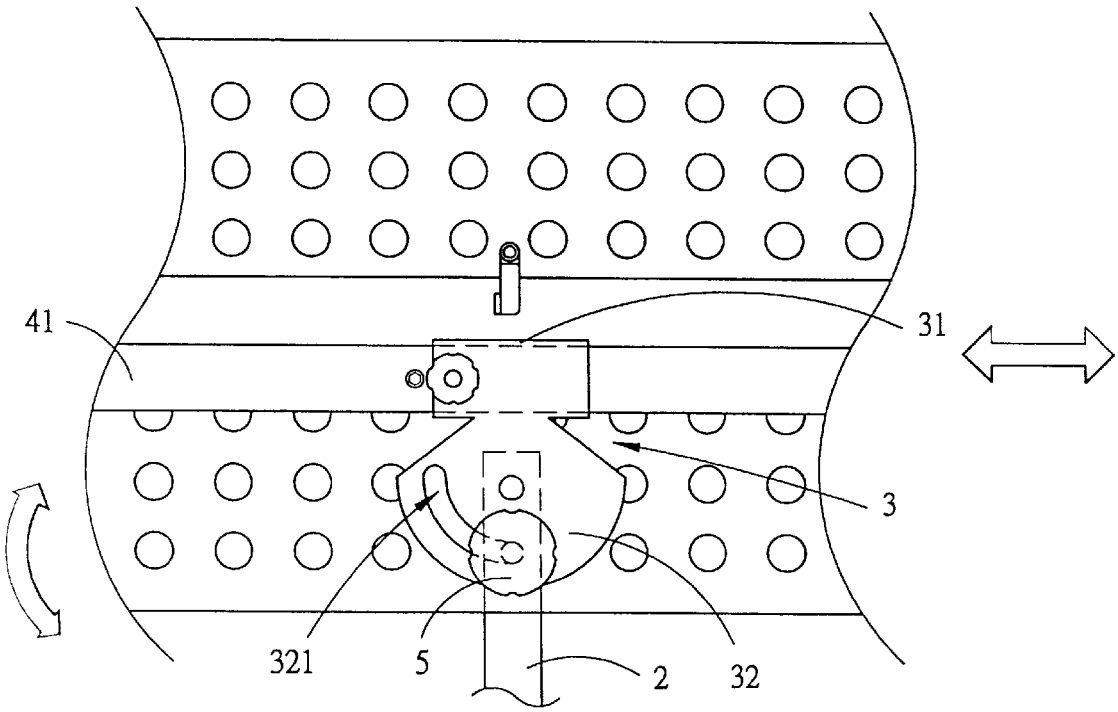
FIG. 3 is a folded schematic view of the present invention.

According to the aforementioned structure, if the music rest 4 is desired to be stored, the foldable plate 22 on the plate frame 42 can be turned downwards so as to be located on the L shape plate 421. Then, the positioning stud 5 on the connector 3 is released and the music rest 4 will be turned downwards, as shown in FIG. 3. Then the music rest 4 is pushed downwards so that the transverse tube 41 of the music rest 4 slides downwards, thus, the music rest 4 and the tripod 1 resist against with one another. Then the telescopic rod 2 is compressed and tripod 1 is folded. Therefore, the volume is reduced.

Figure 4:
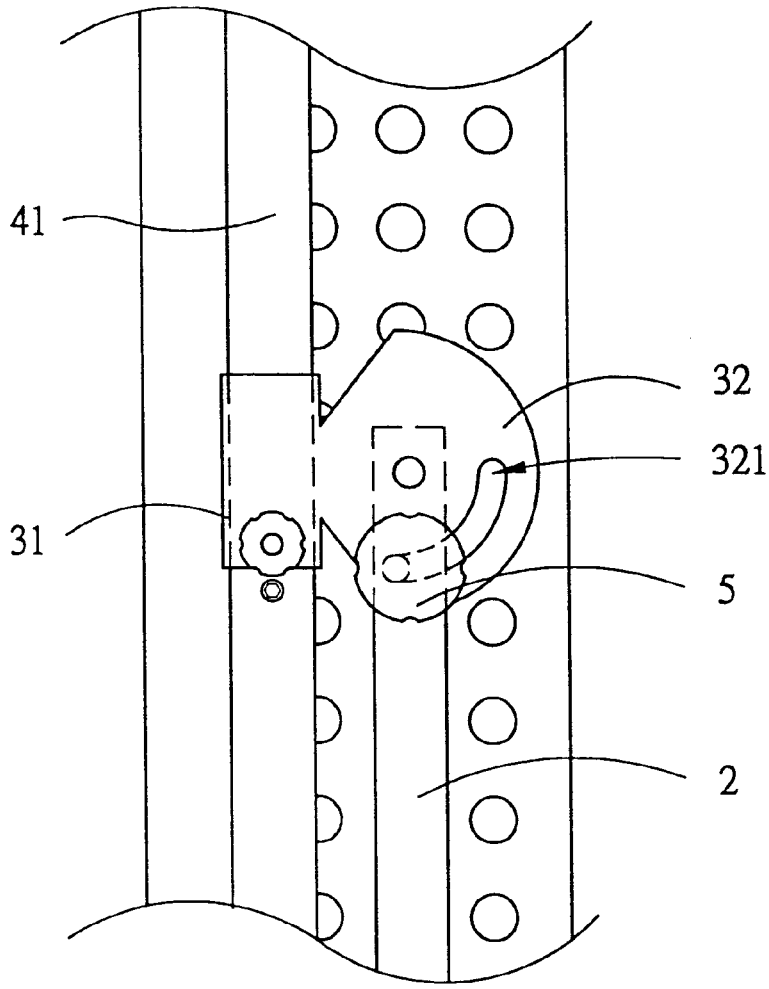
FIG. 4 is a schematic view illustrated that the present invention is expanded for use.

Besides, if the music stand is desired to be expanded for use, after the tripod is expanded, the telescopic rod 2 is pulled upwards, and then the music rest 4 is also pulled upwards so that the middle portion of the music rest 4 is on the connector 3. Then, the music rest 4 is directly rotated upwards. Then, the positioning stud 5 is rotated to a tight position. Then, the music rest 4 is fixed on the connector 3. Then, the foldable plate 422 of the plate frame 42 of the music rest 4 is turned upwards. Therefore, the music stand is expanded for using as shown in FIG. 4.

Since the folding and expanding of the music rest 4 is only necessary to screwedly tighten or release the positioning stud 5 for completely turning the music rest 4, the operation of the present invention is very convenient.

Although the present invention has been described using a specified embodiment, the examples are meant to be illustrative and not restrictive. It is clear that many other variations would be possible without departing from the basic approach demonstrated in the present invention.

What is claimed is:

1. A music stand comprising: a tripod, a telescopic rod installed on a tripod, a connector installed on the telescopic rod, a music rest installed on the connector, a transverse tube installed on the connector, wherein the music rest is formed by a plate frame formed by an L shape plate and a foldable plate pivotally installed on a transverse rod; the transverse rod of the music rest passes through the transverse tube on the connector and is movable within the transverse tube so that the foldable plate is turned downwards to be on the L shape plate; and thus the music rest is pushed downwards and folded; the connector being pivotally installed on a top of the telescopic rod, two cambered plates being installed below the connector and a cambered groove being formed on the cambered plates; a positioning stud passing through the cambered groove and being screwedly installed on the telescopic rod, thus, by loosing or tightening the positioning stud the music rest on the connector can be easily turned.

* * * * *